United States Patent [19]

Johnson, Jr.

[11] Patent Number: 4,945,689

[45] Date of Patent: Aug. 7, 1990

[54] COLLAPSIBLE GRIDWORK FOR FORMING STRUCTURES BY CONFINING FLUENT MATERIALS

[76] Inventor: Robert H. Johnson, Jr., 320 E. Main St., Lancaster, Ohio 43130

[21] Appl. No.: 269,774

[22] Filed: Nov. 9, 1988

Related U.S. Application Data

[62] Division of Ser. No. 27,281, Mar. 17, 1987, Pat. No. 4,785,604.

[51] Int. Cl.[5] ..... E04C 5/04

[52] U.S. Cl. ..... 52/668

[58] Field of Search ..... 52/662, 581, 666, 668, 52/669

[56] References Cited

U.S. PATENT DOCUMENTS

| | | | |
|---|---|---|---|
| Re. 31,176 | 3/1983 | Raubenheimer . | |
| 213,848 | 4/1879 | Stevens . | |
| 1,081,476 | 12/1913 | Wellen . | |
| 1,412,742 | 4/1922 | Herbermann . | |
| 1,528,341 | 3/1925 | Navarro . | |
| 1,896,957 | 2/1933 | Hutcheson . | |
| 1,909,771 | 5/1933 | Lagaard . | |
| 1,995,482 | 3/1935 | Plautz . | |
| 2,069,391 | 2/1937 | Sample . | |
| 2,121,173 | 6/1938 | MacPherson . | |
| 2,123,931 | 7/1938 | Bunker | 52/669 |
| 2,205,758 | 6/1940 | Clark . | |
| 2,315,448 | 3/1943 | Wagin . | |
| 2,369,604 | 2/1945 | Ployer | 52/662 |
| 2,466,275 | 4/1949 | Ringel . | |
| 2,486,743 | 11/1949 | Haffner . | |
| 2,509,732 | 5/1950 | Ernestus | 52/668 |
| 2,645,985 | 7/1953 | Beebe | 52/669 |
| 2,707,537 | 5/1955 | Kilemnik . | |
| 2,920,782 | 1/1960 | Butters . | |

(List continued on next page.)

FOREIGN PATENT DOCUMENTS

| | | | |
|---|---|---|---|
| 0048006 | 6/1980 | European Pat. Off. . | |
| 0039448 | 11/1981 | European Pat. Off. . | |
| 127104 | 6/1902 | Fed. Rep. of Germany . | |
| 660199 | 4/1938 | Fed. Rep. of Germany | 52/668 |
| 160199 | 5/1938 | Fed. Rep. of Germany . | |
| 717032 | 12/1931 | France | 52/668 |
| 1244800 | 9/1960 | France . | |
| 197808 | 8/1978 | France . | |
| 6708323 | 12/1967 | Netherlands . | |
| 332427 | 7/1930 | United Kingdom | 52/581 |

OTHER PUBLICATIONS

"Investigation of Beach Sand Trafficability Enhancement Using Sand-Grid Confinement and Membrane (List continued on next page.)

*Primary Examiner*—Henry E. Raduazo

*Attorney, Agent, or Firm*—Killworth, Gottman, Hagan & Schaeff

[57] ABSTRACT

Collapsible gridworks for confining fluent materials within cells defined by the gridworks to form stable columns capable of withstanding substantial vertical and horizontal loading are each made up of a plurality of interwoven/intermeshed longitudinal and latitudinal strips. In the preferred embodiment, the strips include slots formed on alternating sides thereof, with the gridworks being formed by interweaving the slots on one side of the longitudinal strips with corresponding slots on the opposite side of the latitudinal strips such that the gridwork is defined by mechanically interlocking joints which permit motion for collapsing the gridwork into both a multilayer strip and a substantially flat sheet. The open state of the grid work and both of its collapsed states are similarly stable and can be freely handled without fear of the gridwork falling apart. The strips may be extended in width in reinforce and stabilize stacked gridworks, with the widthwise extensions of the strips being slotted for such stacking. The strips may also be extended in length beyond the outermost walls of the gridwork and slotted such that two or more of the gridworks can be interconnected to one another by interweaving the slotted length extensions of the longitudinal and latitudinal strips.

21 Claims, 7 Drawing Sheets

U.S. PATENT DOCUMENTS

| | | | |
|---|---|---|---|
| 3,050,162 | 8/1962 | Zingone . | |
| 3,378,980 | 4/1968 | Blitzer | 52/668 |
| 3,549,007 | 12/1970 | Charrier . | |
| 3,616,111 | 10/1971 | Raech, Jr. . | |
| 3,762,124 | 10/1973 | DeTonge . | |
| 3,807,116 | 4/1974 | Flynn . | |
| 3,942,709 | 3/1976 | Gepfer . | |
| 3,942,837 | 3/1976 | Engle . | |
| 4,000,845 | 1/1977 | Zeller . | |
| 4,005,943 | 2/1977 | Devenish et al. . | |
| 4,168,924 | 9/1979 | Draper et al. . | |
| 4,189,129 | 2/1980 | Little . | |
| 4,194,675 | 3/1980 | Peters, Jr. . | |
| 4,288,175 | 9/1981 | Baker et al. . | |
| 4,358,047 | 11/1982 | Raubenheimer . | |
| 4,384,810 | 5/1983 | Neumann . | |
| 4,409,770 | 10/1983 | Kawagachi | 52/666 |
| 4,448,571 | 5/1984 | Eckels . | |
| 4,452,025 | 6/1984 | Lew . | |
| 4,502,815 | 3/1985 | Scales et al. . | |
| 4,555,201 | 11/1985 | Paoluccio . | |
| 4,572,705 | 2/1986 | Vignon et al. . | |
| 4,591,090 | 5/1986 | Collins et al. . | |

OTHER PUBLICATIONS

Reinforcement Concepts", Report 2, Sand Test Sections 3 and 4, Steve L. Webster, Technical Report GL-79-20, Feb. 1981.

"Troop Evaluation of New Sand-Grid Artillery Emplacement Concept", Maj. Robert W. White, Structures Laboratory, Engineering and Scientific Research at WES, vol. 0-83-1, Jun. 1983.

"Sand-Grid Demonstration Road Constructed at Fort Story, Virginia", Steve L. Webser, Engineering and Scientific Research at WES vol. 0-84-1, Jan. 1984.

"WES Developing Sand-Grid Confinement System", Jul.-Aug. 1981, Army Research, Development & Acquistion Magazine, p. 7.

Brochure entitled "GEOWEB Grid Confinement System", by Presto Products Inc.

"Analysis of Grid Cell Reinforced Pavement Bases," by James K. Mitchell, T-C Kao. Edward Kawazanjian, Jr., Technical Report GL-79-8, Jul. 1979.

"Investigation of Beach Sand Trafficability Enhancement Using Sand-Grid Confinement and Membrane Reinforcement Concepts", Report 1, Sand Test Sections 1 and 2, by Steve L. Webster, Technical Report GL-79-20, Nov. 1979.

"Investigation by Construction Concepts for Pavements Across Soft Trand," Steve L. Webster, Samuel J. Alford, Technical Report S-78-6, Jul. 1978.

COLLAPSIBLE GRIDWORK FOR FORMING STRUCTURES BY CONFINING FLUENT MATERIALS

This application is a division of U.S. patent application Ser. No. 027,281 filed Mar. 17, 1987 and now U.S. Pat. No. 4,785,604.

FIELD OF THE INVENTION

This invention relates generally to structures constructed of fluent materials, such as soils, sands, rocks, aggregates and the like, and more particularly, to a collapsible gridwork for confining such fluent materials within cells defined by the gridwork to convert the fluent materials into stable columns capable of withstanding substantial vertical and horizontal loading.

BACKGROUND OF THE INVENTION

Structures formed by piling, stacking, organizing or confining soils, sands, rocks, aggregates and the like for both temporary and permanent placement are well known. Examples of such structures range from rock riprap and gabions, to sand filled bags, and are constructed and reinforced with a variety of elements formed from concrete, wood, stone, metal or plastic. Geotextile may also be used to support an underlayment, line gabions or for similar operations to retain aggregate that would normally be lost from the structure and thereby minimize the fill required. While known structures and their related shaping and reinforcing elements can be successfully employed, each has various shortcomings and disadvantages.

For example, the large rocks required for riprap, a common solution for water erosion, may not be readily available. If available, structuring the riprap requires special handling equipment and careful placement or else a significant portion of the large rocks ineffectively accumulate at the bottom of the riprap structure making it necessary to use substantially more material than would otherwise be required. When the large rocks required for riprap are not available, gabions filled with smaller rocks or stones may be substituted. However, because their bulk makes transportation uneconomical, gabions are usually constructed on site and such construction, placement and filling of gabions is very expensive, labor intensive and requires some skill for proper construction.

Slope stabilization may also be accomplished by placing bags or mats which are pumped full of concrete or sand and gravel. While concrete is much more permanent, the expense and availability problems are obvious. When sand and gravel are used, tearing and deterioration present hazards. Transverse arrays of beams, of course, can also be used for slope protection, with the beams being tied into the slope at appropriate intervals. With this arrangement, the durability, cost and extensive excavation required may be prohibitive.

Confinement structures formed by pumping concrete, sand or gravel into tubes, bags or the like are suggested by the basic sandbag confinement structure which is used in many applications, e.g., floodwalls, revetments, barriers, embankments, bulwarks and fortifications. Sandbags can be filled by hand or machine. However, machine filling is uncommon, and of course, requires specialized machinery, while hand filling is very labor intensive and time consuming. Here again, structures formed from filled sandbags are susceptible to tearing and deterioration which can lead to localized failure, and ultimately, the failure of the entire structure.

Crushed stone or gravel is used as a load bearing surface or an underlayment for the construction of roads, railroads and runways. Rutting and failure may quickly occur if such an underlayment is placed on a low bearing strength subgrade. To overcome early failure, a geotextile layer may be placed over the subgrade before the stone bed is formed as previously noted. Still, rutting occurs with time. In addition, a substantial depth of stone fill is still required, and such stone fill may be unavailable or difficult and expensive to obtain. To overcome the problems with such subgrades, a honeycomb-like structure made of strips of plastic material has been provided. The strips are welded together at intervals and may be stretched apart to form individual honeycomb cells, with the cells being filled by the crushed stone or gravel to form the underlayment. Such honeycomb structures, though effective, are heavy and awkward to handle, typically requiring two men to carry a collapsed grid and four to expand the grid prior to filling. Such honeycomb grids have also been reported to be fragile in use.

As an alternative to the plastic honeycomb grids previously mentioned, generally rectangular gridworks formed of aluminum strips have been employed as underlayments. In these structures, a series of strips of aluminum are slotted on one side to approximately the center of the strips. A plurality of the strips are then positioned on edge in a grid or network pattern, with strips running in one direction having the slots directed downwardly and engaging corresponding upwardly facing slots of perpendicularly oriented strips to define a rectangular gridwork of rectangular cells for receiving sand, crushed stone or gravel therewithin.

Such prior art aluminum gridworks resemble "egg-crates." The intersections of the individual strips must be secured to one another, for example, by taping, to prevent the strips from falling from the gridwork if the gridwork is moved as a unit. Such gridworks can be collapsed to form a multilayer strip somewhat longer than any strip comprising the gridwork. While the honeycomb and aluminum gridworks have proved moderately effective, they are expensive and difficult to construct and handle. Further, such gridworks cannot be palletized for storage and transport, and where aluminum strips are used in their construction, such gridworks are subject to bending if improperly handled, which bending can impair or destroy their utility.

It is apparent that the need exists for a lightweight inexpensive confinement and reinforcement structure which would have a broad utility in place of many, if not all, of the noted earthwork structures as well as other applications and which is easy to transport and deploy such that it can be filled with locally available sand, soil, rocks or other fluent materials, either manually or by means of readily available general purpose equipment.

SUMMARY OF THE INVENTION

The various problems of the prior art are overcome in accordance with the present invention which comprises a collapsible gridwork for confining fluent materials within cells defined by the gridwork to convert the fluent materials into stable columns capable of withstanding substantial vertical and horizontal loading. The gridwork although made up of a plurality of strips is collapsible and has a unitary structure which can be handled without fear of the strips becoming disengaged from one another. For many applications, the gridwork may be removed and reused a substantial number of times. In the preferred embodiment of the invention, this is due to the construction of the gridworks by interweaving spaced slots formed on alternate sides of the strips with corresponding slots on the opposite sides of other strips. Hence, the individual strips of the gridwork are mechanically interlocked by means of joints which permit motion for collapsing the gridwork, which motion, however, is constrained by interaction with adjacent joints. Applicant has determined that this interwoven structure permits ready collapse of the gridwork into both a multilayer strip and a substantially flat sheet. Both the collapsed states of the gridwork are similarly stable and can be readily handled without fear of the gridwork falling apart, with the former collapsed state being advantageous for ready deployment of the gridworks, and the latter collapsed state being particularly advantageous for palletized storing and shipment of the gridworks prior to deployment and between usages of the in applications which permit their reuse.

In accordance with one aspect of the present invention, a collapsible gridwork confines fluent materials within cells defined by the gridwork to convert the fluent materials into stable columns capable of withstanding substantial vertical and horizontal loading. The gridwork comprises a first plurality of longitudinal strips having a second plurality of defined spaced slots alternately formed into the sides thereof. A second plurality of latitudinal strips equal in number to the second plurality of slots and having a first plurality of defined spaced slots alternately formed into the sides thereof and equal in number to the first plurality of longitudinal strips are interwoven with the longitudinal strips by engaging slots on one side of the latitudinal strips with corresponding slots on the opposite side of the longitudinal strips to form the gridwork. The slots are of compatible depths such that the longitudinal and latitudinal strips engage one another at inner terminations of the slots.

To facilitate foolproof stacking of the gridworks in alignment one upon another, for example, to form a wall, a single form of gridwork is preferably constructed. For this gridwork, the first and second pluralities are even numbers and each gridwork when viewed in plan always has the top longitudinal strip positioned in the same orientation such that gridworks always have the leftmost slot of the top strip facing downwardly, or alternatively. gridworks always have the leftmost slot of the top strip facing upwardly. Such gridworks of one form or the other may be stably stacked in alignment one upon another regardless of relative orientations of the gridworks since each intersection of an upper gridwork will define a slotless strip surface which perpendicularly engages a slotless strip surface of an intersection of a lower gridwork.

Gridworks in accordance with the present invention may further comprise stabilizing means for reinforcing and aligning gridworks which are stacked one upon another. Such stabilizing means may comprise portions of at least one of the longitudinal strips and/or at least one of the latitudinal strips which are extended vertically beyond the gridwork, with the vertical extensions beyond the gridwork being slotted to permit stacking. Such vertical extensions may be particularly advantageous for the outermost longitudinal strips and/or the outermost latitudinal strips.

Two or more gridworks in accordance with the present invention can be interlocked to one another by means of extensions in the length of the longitudinal strips beyond the outermost latitudinal strips and/or the latitudinal strips beyond the outermost longitudinal strips, with such length extensions including gridwork coupling means formed therein. Preferably, the gridwork coupling means comprises slots formed in accordance with the slot pattern for the corresponding strip, but at a reduced slot spacing. Gridworks are then interlocked to one another by interleaving the slots of the longitudinal and/or latitudinal length extensions. Foolproof interlocking of two or more gridworks can be ensured by selecting the first and second plurality of strips as being even numbers.

While it is not necessary for gridworks in accordance with the present invention, the slots in the longitudinal and latitudinal strips may be uniformly spaced. For such spacing, it may be advantageous to facilitate stacking and interconnection of two or more gridworks to one another to define the spacings of the slots in the length extensions of the longitudinal and/or latitudinal strips as being one-half a uniform spacing between the remaining slots in the strips such that cells formed by interlocking the length extensions of two or more gridworks are substantially the same size as the remaining cells of the gridworks.

If a gridwork in accordance with the present invention is to be used on an incline, it may be desirable to provide the slots in the strips which are to be inclined at an angle which is complementary to the angle of the incline, for example, at an angle between 30° and 90°, such that the strips which run across the incline present substantially vertical cell walls for the gridwork.

In accordance with a second aspect of the present invention, a collapsible gridwork for confining fluent materials within cells defined by the gridwork to convert the fluent materials into stable columns capable of withstanding substantial vertical and horizontal loading comprises a first plurality of longitudinal strips having a second plurality of defined spaced slots which can be, but need not be, uniformly spaced, alternately formed into the sides thereof. A second plurality of latitudinal strips, equal in number to the second plurality of slots having a first plurality of defined spaced slots which can be, but need not be, uniformly spaced, alternately formed into the sides thereof, with the slots being equal in number to the first plurality of longitudinal strips, are interwoven with the longitudinal strips. The longitudinal and latitudinal strips are of equal width and interwoven by engaging slots on one side of the longitudinal strips with corresponding slots on the opposite side of the latitudinal strips to form the gridwork. The slots are of compatible depths to permit the sides of the longitudinal strips and the latitudinal strips to be in substantial alignment when interwoven such that the gridwork can be collapsed to either a multilayer strip somewhat longer than the longitudinal strips or a substantially flat rectangular shape.

In accordance with another aspect of the present invention, a collapsible gridwork for confining fluent materials within cells defined by the gridwork to convert the fluent materials into stable columns capable of withstanding substantial vertical and horizontal loading comprises a first plurality of longitudinal strips having a second plurality of defined spaced slots alternately formed into the sides thereof. A second plurality of latitudinal strips equal in number to the second plurality of slots and having a first plurality of defined spaced slots equal in number to the first plurality of strips alternately formed into the sides thereof are interwoven with the longitudinal strips. Slots on one side of the longitudinal strips are engaged with corresponding slots on the opposite side of the latitudinal strips to form the gridwork, with the slots being of compatible depths such that the longitudinal and latitudinal strips engage one another at inner terminations of the slots. The longitudinal and latitudinal strips comprise base strips defined by secondary slots formed into one side of the strips in alignment with the slots formed into the opposite side of the strips The vertical extensions of the longitudinal and latitudinal strips beyond the base strips facilitate stacking of the gridworks by overlapping portions of the base strip of another gridwork to reinforce and unitize the columnar cells formed by stacking two or more of the gridworks one upon another. Preferably, the corners of the vertical extensions are cut or rounded to facilitate stacking of two or more gridworks one upon another. Such stacking is also facilitated by making the vertical extensions of the longitudinal strips differ in length from the vertical extensions of the latitudinal strips.

In accordance with yet another aspect of the present invention, a collapsible gridwork for confining fluent materials within cells defined by the gridwork to convert the fluent materials into stable columns capable of withstanding substantial vertical and horizontal loading comprises a first plurality of longitudinal strips having defined spaced slots alternately formed into the sides thereof. The longitudinal strips are interwoven with a second plurality of latitudinal strips having defined spaced slots alternately formed into the sides thereof by engaging slots on one side of the longitudinal strips with corresponding slots on the opposite side of the latitudinal strips to form the gridwork. The slots are of compatible depths such that longitudinal and latitudinal strips engage one another at inner terminations of the slots. The longitudinal and latitudinal strips of such a collapsible gridwork may be of varying lengths such that the gridwork defines a substantially triangular corner section of a rectangular gridwork, and may be used to conjoin two or three other gridworks to one another.

In accordance with still another aspect of the present invention, a collapsible gridwork for confining fluent materials within cells defined by the gridwork to convert the fluent materials into stable columns capable of withstanding substantial vertical and horizontal loading comprises a plurality of strips each having defined spaced slots formed into one side thereof, which strips are divided into two groups which are perpendicularly oriented to one another and positioned such that strips of one group have all slots facing upwardly and strips of the other group have all slots facing downwardly. The gridwork is formed by intermeshing the upwardly facing slots with the downwardly facing slots, with the plurality of strips further defining means for interlocking the strips to stabilize the gridwork yet permit the gridwork to be collapsed into a multilayer strip somewhat longer than any of the plurality of strips.

It is a primary object of the present invention to provide a gridwork for confining fluent materials within cells to form stable columns capable of withstanding substantial vertical and horizontal loading by interweaving longitudinal and latitudinal strips by means of slots formed in alternate sides of the strips of compatible depths to permit the longitudinal and latitudinal strips to engage one another at inner terminations of the slots, which gridwork is stable and can be handled without fear of the strips falling apart, and which can be conveniently collapsed into a multilayer strip configuration or a substantially flat configuration.

It is another object of the present invention to provide a collapsible gridwork for confining fluent materials to define stable columns capable of withstanding substantial vertical and horizontal loading comprising a plurality of longitudinal strips which are interwoven with a plurality of latitudinal strips by means of slots which are alternately formed on the sides of the strips, with slotted length extensions being formed onto the longitudinal and/or latitudinal strips to permit two or more gridworks to be interconnected to form an expanded gridwork structure.

It is an additional object of the present invention to provide a collapsible gridwork for confining fluent materials to define stable columns capable of withstanding substantial vertical and horizontal loading by interweaving a plurality of longitudinal strips and a plurality of latitudinal strips by means of compatible depth slots alternately formed into the sides of the strips, which gridworks can be vertically stacked one upon another to define a wall structure.

It is yet another object of the present invention to provide a collapsible gridwork for confining fluent materials to define stable columns capable of withstanding substantial vertical and horizontal loading by interleaving a plurality of longitudinal strips and a plurality of latitudinal strips by means of compatible depth slots formed into one side of said strips which include means for interlocking the strips to stabilize the gridwork yet permit the gridwork to be collapsed into a multilayer strip somewhat longer than the longitudinal strips.

Other objects and advantages of the invention will be apparent from the following description, the accompanying drawings and the appended claims.

DETAILED DESCRIPTION OF THE INVENTION

Figure 1:
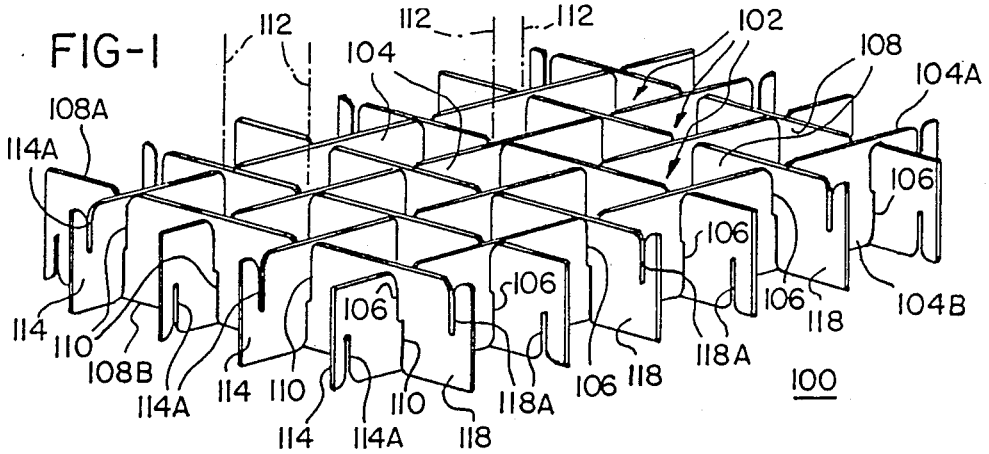
FIG. 1 is a perspective view of a collapsible gridwork in accordance with the present invention in its fully expanded form ready to receive and confine fluent materials.

A collapsible gridwork 100 in accordance with the present invention is shown in perspective view in FIG. 1 fully expanded such that the cells 102 are substantially rectangular in form. The cells 102, as well as the overall gridworks 100, can be sized to accommodate a specific application or a variety of applications. Preferably, a number of standard size gridworks 100 would be provided and stocked such that a wide variety of applications could be accommodated by the standard sizes of gridworks. Of course the cells 102 of any gridwork can be adjusted by skewing the gridwork 100 such that the cells 102 take on a desired parallelogram shape. Such skewing of the gridworks 100 is advantageously applied when forming contiguous gridwork structures as will become apparent particularly with reference to FIGS. 15 and 16.

The collapsible gridwork 100 comprises a first plurality of longitudinal strips 104 having a second plurality of defined spaced slots 106 alternately formed into the sides 104A and 104B of the longitudinal strips 104. A second plurality of latitudinal strips 108 equal in number to the second plurality of slots 106 also has a first plurality of defined spaced slots 110 alternately formed into the sides 108A and 108B of the latitudinal strips 108. The defined spaced slots 110 formed in the latitudinal strips 108 are equal in number to the first plurality of longitudinal strips 104.

As shown in FIG. 1, the longitudinal strips 104 and the latitudinal strips 108 are of equal width although varying width strips can be utilized in accordance with the present invention. The gridwork 100 is formed by interweaving the longitudinal strips 104 and the latitudinal strips 108 by interengaging the slots 106 with the slots 110. The longitudinal strips 104 are interwoven with the latitudinal strips 108 such that upwardly extending slots 106 in the longitudinal strips 104 receive downwardly extending slots 110 in the latitudinal strips 108.

The slots 106 and 110 are shown as extending approximately halfway through the strips 104 and 108, respectively; however, all that is necessary is that the slots 106 be of compatible depths with the slots 110 such that the sides of the longitudinal strips 104 and the sides of the latitudinal strips 108, which are substantially equal in width as shown in FIG. 1, are in substantial alignment when interwoven. Hence, for example, the slots 106 could extend one-third of the way through the longitudinal strips 104. Provided the slots 110 extended two-thirds of the way through the latitudinal strips 108.

The strips 104,108 may be constructed from a wide range of materials. Such materials, of course, must provide the strips 104,108 with sufficient flexibility to alloW the strips 104,108 to be interwoven into the gridwork structure shown in FIG. 1. The materials should also have sufficient load and tear strength for the required structure, and should also appropriate environmental resistance for the intended use. Black polyethylene is a suitable material for the manufacture of the gridworks 100 in accordance with the present invention. Of course, many other polymeric materials may be used, such as polypropylene, acrylonitrile-butadiene-styrene, polymethyl methacrylata, and polycarbonate. The material may also be reinforced by various fillers including metal fillers should it be desirable to locate the structure using metal detection techniques. For temporary usage, a biodegradable material could be used, as could one which is degraded by ultraviolet radiation. Various colors to blend in with the surroundings of a structure, including camouflage colors, could be incorporated into the strips.

The interwoven construction of the longitudinal strips 104 and the latitudinal strips 108, as described and shown, produces a gridwork 100 in which the strips are mechanically interlocked such that the gridwork 100 can be conveniently handled without fear of any of the strips 104,108 becoming disengaged from the gridwork 100. The individual joints defined by the interengaged slots 106 and 110 are capable of both rotational and axial translational movement which is constrained by interaction with adjacent joints through the interwoven structure of the gridwork 100. The joints defined by the engagement of the slots 106 and 110 permit the gridwork 100, in accordance with the present invention, to be collapsed to either a multilayer strip somewhat longer than the longitudinal strips 104 or to a substantially flat rectangular configuration. The unique collapsible nature of the gridwork 100 will now be described with reference to FIGS. 2A–2F.

Figure 2C:
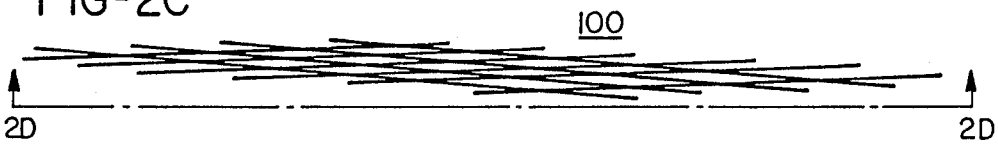
FIGS. 2A–2F, when viewed in order, show the collapse of a gridwork in accordance with the present invention from a fully expanded form to a collapsed strip form and ultimately to a substantially flat rectangular form.
Figure 2B:
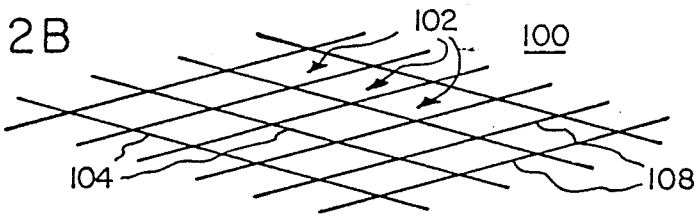
Figure 2A:
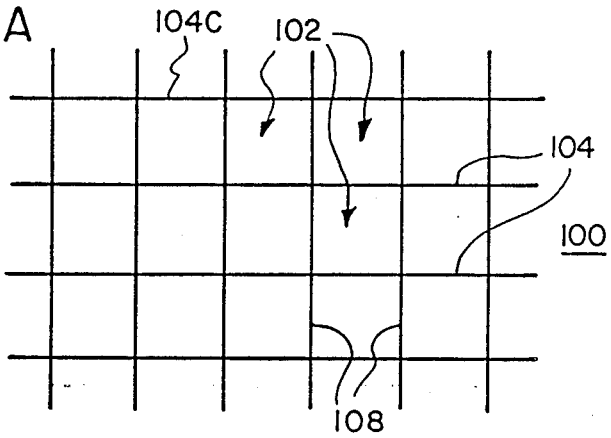

FIG. 2A is a plan view of a fully expanded gridwork 100 in accordance with the present invention. As will be apparent, the gridwork 100 can be collapsed by rotation about the axes 112 defined by the interengaged slots 106 and 110 (see FIG. 1). Ultimately, such movement about the axes 112 leads to a first collapsed configuration of the gridwork 100, as shown in FIG. 2C, with one intermediate configuration shown in FIG. 2B. In FIG. 2C. the gridwork 100 has been collapsed to a multilayer strip somewhat longer than the longitudinal strips 104.

The collapsed multilayer strip configuration of the gridwork 100 shown in FIG. 2C ranges in thickness from approximately the sum of the thicknesses of a longitudinal strip 104 and a latitudinal strip 108 at its ends to approximately the sum of the thicknesses of all of the strips of lesser number, in this case, the longitudinal strips 104, plus an equal number of the strips of greater number, in this case, the latitudinal strips 108, at its center. The collapsed multilayer strip configuration shown in FIG. 2C is convenient for transportation of the gridwork 100 in the field. For example, the central portion of the strip can be thrown over one's shoulder and the ends allowed to sag down in front and behind the person carrying the gridwork 100.

The collapsed multilayer strip shown in FIG. 2C can be further collapsed into a substantially flat rectangular shape having a much thinner thickness throughout which is particularly advantageous for storage and transportation of the gridworks 100, for example, by palletizing the gridwork. Such further collapsing will now be described with reference to FIGS. 2D–2F.

Figure 2F:
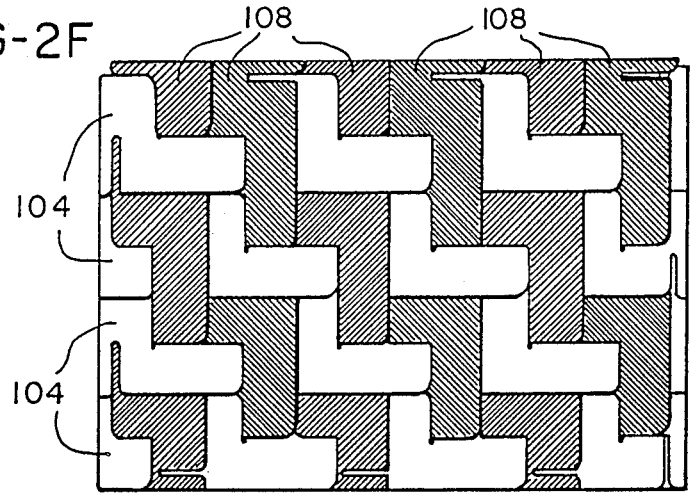
Figure 2E:
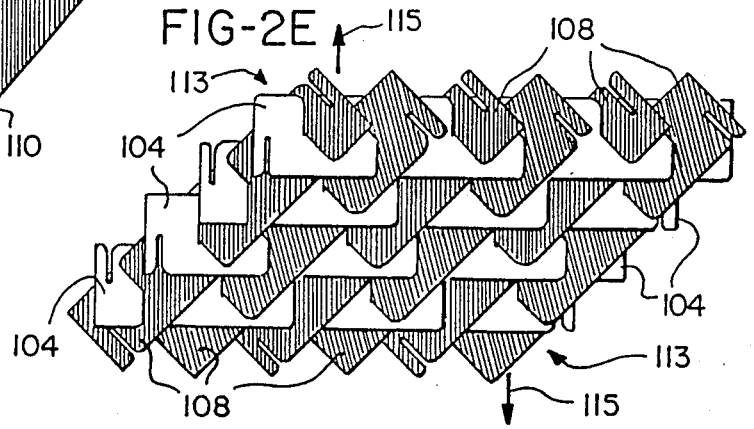
Figure 2D:
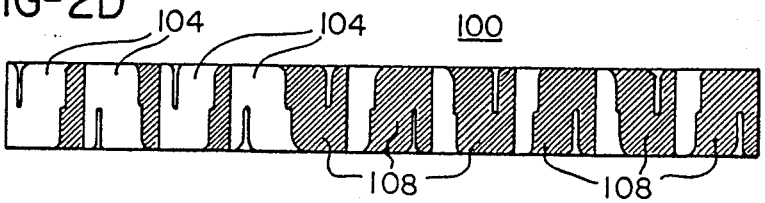

FIG. 2D shows a side view of the collapsed multilayer strip configuration of the gridwork 100 of FIG. 2C viewed along the line 2D. This orientation of the collapsed multilayer strip configuration of the gridwork 100 is obtained by rotating the collapsed gridwork 100 as shown in FIG. 2C over onto one of its sides. The gridwork 100 is then further collapsed to its rectangular form shown in FIG. 2F by pulling the corners 113 and sides outwardly as shown by the arrows 115 in FIG. 2E. The strips 104 and 108 making up the gridwork 100 then rotate upon each other at the inner terminations of the slots 106 and 110, as shown in FIG. 3 on an enlarged scale, to form the substantially flat rectangular configuration of the gridwork 100 having a greatly reduced thickness as shown in FIG. 2F.

Figure 3:
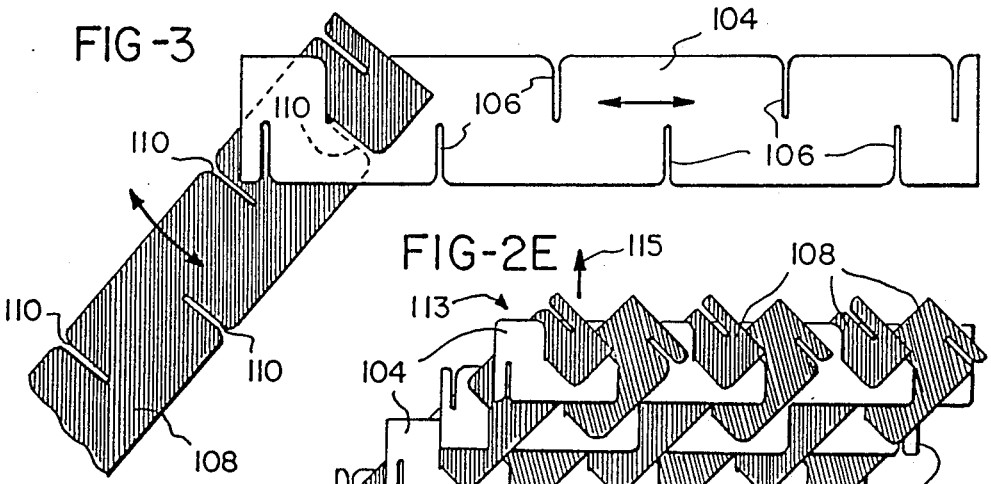
FIG. 3 shows the rotational motion of a joint formed by two interwoven strip slots of the gridwork of FIG. 1.

The thickness of the rectangular configuration of the gridwork 100 shown in FIG. 2F varies from the thickness of one of the longitudinal strips 104 or latitudinal strips 108 to a sum of approximately three of their thicknesses for a simple gridwork 100. The thickness of the flat configuration of a gridwork in accordance with the present invention varies dependent upon the construction of the particular gridwork. For example, if one or more of the strips 104,108 are expanded in width or outer reinforcing walls are added to the gridwork 100, variations in the thickness of the flat configuration occur for the gridwork.

Figure 4:
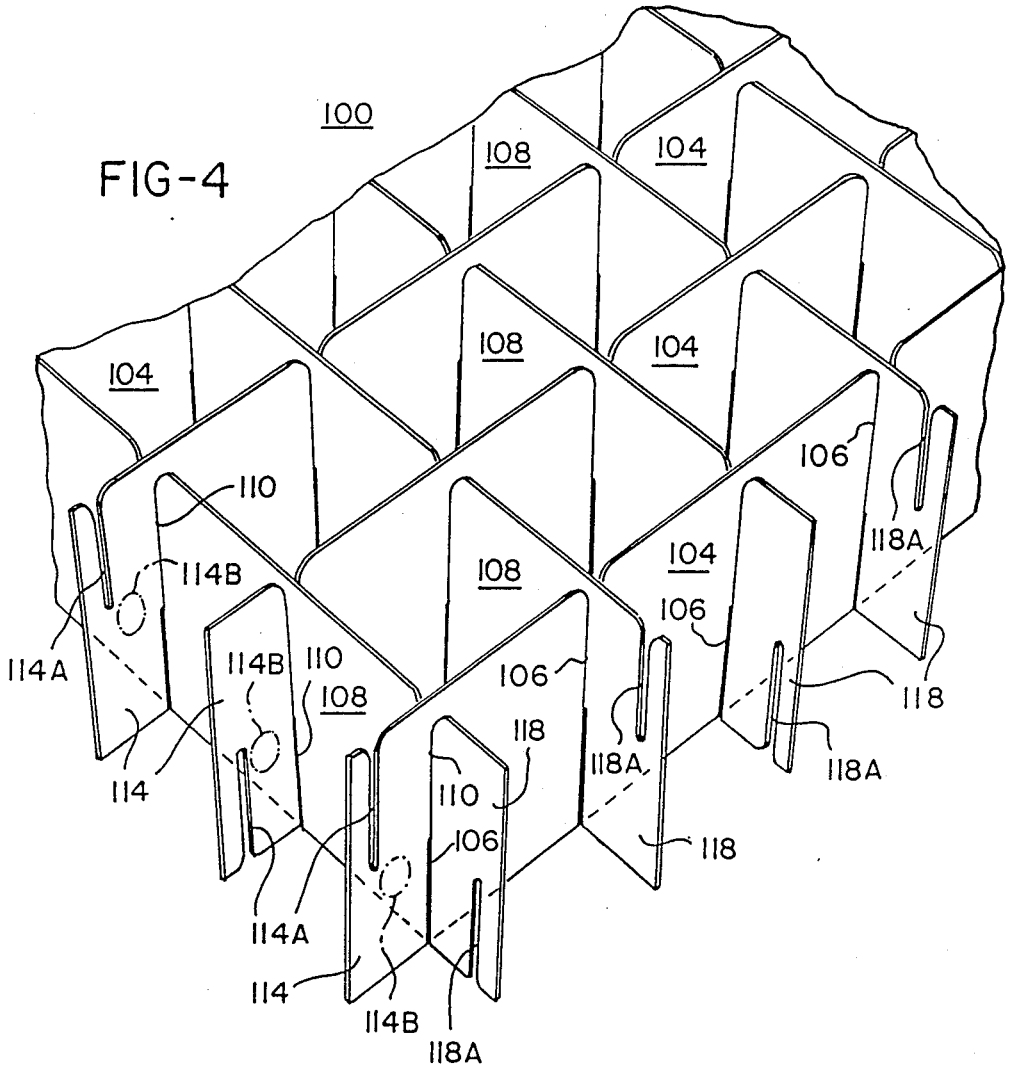
FIG. 4 shows a corner section of a gridwork in accordance with the present invention.

FIG. 4 shows a corner section of a gridwork in accordance with the present invention similar to the gridwork of FIG. 1, but on an expanded scale, and including longitudinal and latitudinal extensions in the lengths of the strips 104 and 108, which length extensions are of a somewhat reduced length as compared to the length extensions of FIG. 1. The longitudinal strips 104 include longitudinal length extensions 114 which extend beyond the outermost latitudinal strips 108, and the latitudinal strips 108 include latitudinal length extensions 118 which extend beyond the outermost longitudinal strips 104. The longitudinal length extensions 114 and the latitudinal length extensions 118 include gridwork coupling means formed thereinto for interconnecting two or more gridworks to one another.

As shown in FIGS. 1 and 4, the gridwork coupling means comprises slots 114A in the longitudinal length extensions 114 and slots 118A in the latitudinal length extensions 118. The spacing of the slots 114A in the longitudinal length extensions 114 of the longitudinal strips 104 and the slots 118A in the latitudinal length extensions 118 of the latitudinal strips 108 is at a reduced slot spacing as compared to the standard longitudinal and latitudinal strip slot pattern in the illustrated embodiments of the gridworks 100. Two or more gridworks can be interlocked to one another by interleaving the longitudinal length extensions 114 or the latitudinal length extensions 118 with longitudinal length extensions 114 or latitudinal length extensions 118 of another gridwork 100 by engaging the slots 114A,118A of the gridworks to be interconnected.

To facilitate interconnection of gridworks in accordance with the illustrated gridwork coupling means. i.e., alternating slots, it is preferred to have an even number of longitudinal strips 104 and an even number of latitudinal strips 108 which are consistently constructed to define a single gridwork structure. Such a consistent gridwork structure is defined by viewing the open gridwork in plan view, such as shown in FIG. 2A. and constructing the gridwork such that the top longitudinal strip 104C is positioned in the same orientation for all such gridworks. i.e., the gridwork always has the leftmost slot of the top longitudinal strip 104C facing downwardly or the gridwork always has the leftmost slot of the top longitudinal strip 104C facing upwardly. In this way, two or more gridworks of the same construction can be conveniently interconnected to one another regardless of orientation and the interconnections can define contiguous sidewalls for two or more interconnected gridworks, or a gridwork may be branched from another gridwork, with the branching walls of the gridworks forming contiguous corner walls.

It is noted that other gridwork coupling means can be provided on the length extensions 114 and 118, such as by means of aligned holes 114B, as shown in dotted lines in FIG. 4, such that a rod, cable or the like can be passed through the holes when gridworks are positioned adjacent to one another to thereby connect the gridworks. Also, if an interlocking arrangement was not required, the slots 114A. 118A can be formed in the length extensions 114 and 118 such that on one side of the gridwork, the slots face downwardly, and on the other side of the gridwork, the slots face upwardly. Two gridworks could then be connected together simply by lowering the length extensions of one gridwork onto the length extensions of another gridwork and intermeshing the slots in the length extensions. These, as well as other gridwork coupling means which will be suggested to those of skill in the art upon reviewing this disclosure, are considered to be a part of the present invention.

The slots 114A and 118A in the length extensions 114 and 118 are spaced at a reduced spacing compared to the alternating slot spacing for the longitudinal strips 104 and the latitudinal strips 108. The spacing of the slots 114A and 118A. as shown in FIG. 1, is approximately one-half the regular slot spacing for those strips. Such spacing facilitates interconnection and stacking of gridworks since the cells formed by interconnecting the length extensions 114 and 118 are the same size as the remaining cells 102 of the gridworks 100 which are interconnected.

Figure 9:
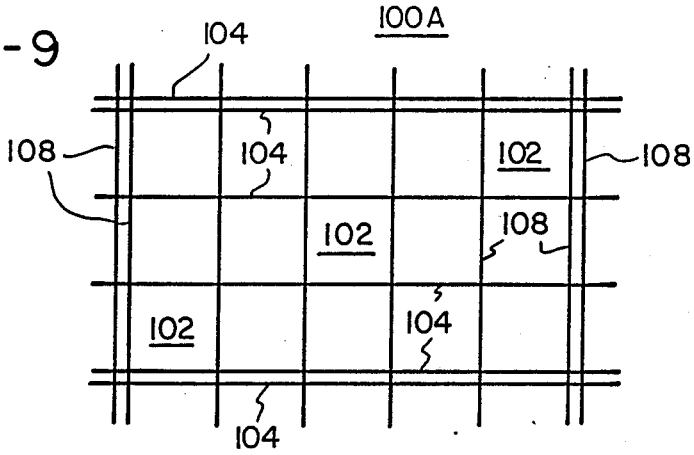
FIG. 9 is a plan view of a gridwork having double outside walls for reinforcement purposes.

As shown in FIG. 4, the spacing of the slots 114A and 118A is somewhat less than one-half the regular slot spacing for the alternating slots in the strips 104 and 108. Such spacing can be particularly beneficial if a reinforcing wall is desired for one or more sides of a gridwork. A reinforcing wall may be particularly useful for a base gridwork 100A upon which additional gridworks 100 are then stacked. In FIG. 9, a plan view of the base gridwork 100A is shown wherein additional longitudinal strips 104 and latitudinal strips 108 have been interwoven with the longitudinal length extensions 114 and the latitudinal length extensions 118 to form reinforcing walls around the entire exterior of the gridwork 100A.

Applicant has determined that the preferred interwoven structure for the gridworks 100 in accordance with the present invention permits ready collapse of the gridworks 100 into both the multilayer strip configuration shown in FIGS. 2C and 2D. as well as a substantially flat rectangular sheet configuration shown in FIG. 2F. While it should be apparent how base gridworks 100 in accordance with the present invention are constructed, collapsed and opened in view of the above description, applicant has further determined that such gridworks can include extensions of one or more of the strips either in length or width. The widths of strips can be varied such that one or more of the strips extend vertically beyond the gridwork 100 when the gridwork is opened, for example, to reinforce or align stacked gridworks. Further, either the longitudinal or latitudinal strips 104,108 can include slots angled at, for example, between 30° and 90°, such that the interwoven latitudinal or longitudinal strips 108,104 define substantially vertical cell walls when gridworks 100B, constructed of strips having such angled slots, are positioned on an incline having a complementary angle of incline (see FIGS. 8 and 18–20).

The spacing between strips has been shown as being uniform in the illustrated embodiments of the present invention for ease of description and illustration. However, uniform spacing of the strips is not required for gridworks in accordance with the present invention. Nonuniform spacing may be desirable, for example, if it is necessary to define an oversized cell or series of stacked oversized cells to receive a vertical support beam for a wall structure made with gridworks in accordance with the present invention. The inclusion of such strips and nonuniform strip spacing in the gridworks 100 does not effect the ability of the gridworks to collapse either to a multilayer strip configuration, as shown in FIGS. 2C or 2D, or to the substantially flat configuration shown in FIG. 2F.

Figure 5:
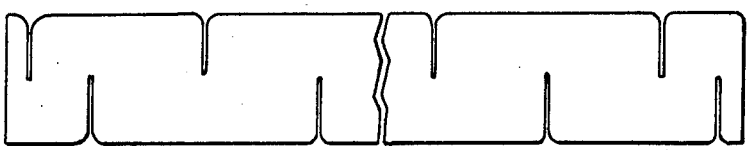
FIGS. 5–8 show some of the variations which can be made in the strips used to form gridworks in accordance with the present invention to provide alternate gridwork embodiments.
Figure 6:
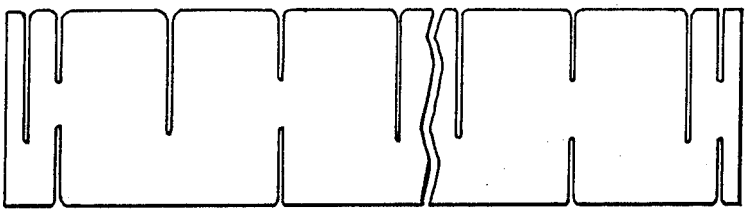
Figure 7:
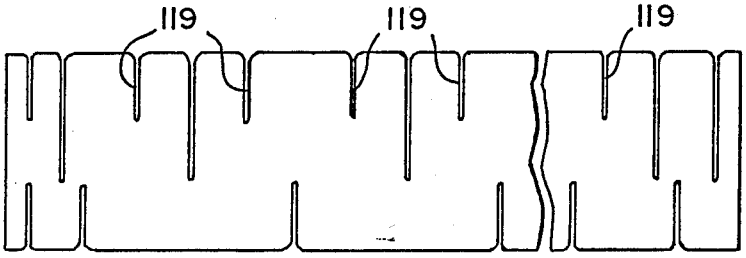
Figure 8:
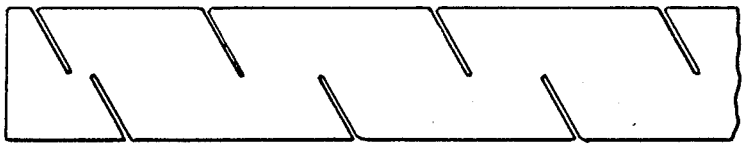

Examples of strips which have been utilized in gridworks constructed in accordance with the present invention are illustrated in FIGS. 5–8. FIG. 5 shows a basic strip, two lengths of which could be utilized to construct the gridwork 100 of FIGS. 1 and 4. FIG. 6 shows a strip having an extended width, two lengths of which can be utilized to construct the gridworks of FIGS. 10 and 12. FIG. 7 shows a strip having an extended width much like the strip of FIG. 6, but with additional slots 119 which are offset from all remaining slots in the strip to permit gridworks to be stacked in an offset pattern wherein strips of gridworks are received within the offset slots. While such offset or staggered stacking may be acceptable for some applications, it is not as advantageous as the preferred stacking arrangements which will be described.

As previously suggested, gridworks made in accordance with the present invention can be conveniently stacked in order to form stable reinforcing walls for structures formed from fluent materials, such as soil, sand, rocks, or even grains, and the like if temporary storage is to be provided. It is noted that these gridworks, once in place can be filled by shovel or by means of a general purpose frontloader or the like. Stacking of the gridworks can be facilitated by vertically extending, i.e., extending the width of the outer longitudinal strips 104 and/or latitudinal strips 108 of a gridwork 100 and slotting the extensions such that they serve to reinforce and align stacked gridworks 100. Additionally, one or more of the interior longitudinal strips 104 or latitudinal strips 108 may be increased in width and slotted to accommodate stacking since the extension in width of such walls tends to stabilize stacked gridworks 100.

Figure 10:
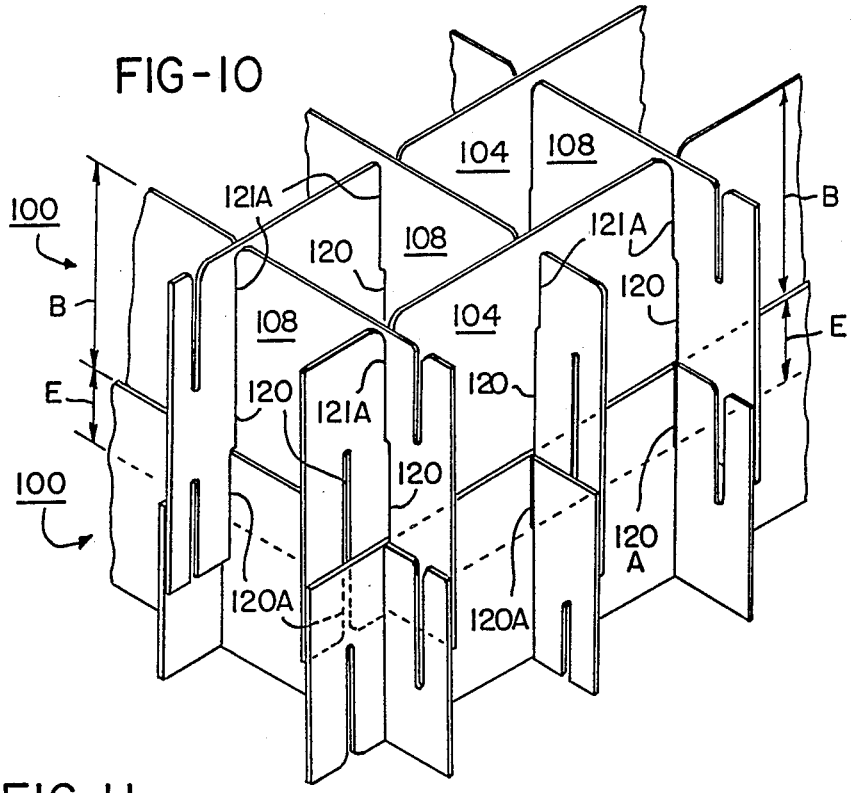
FIG. 10 shows gridworks in accordance with the present invention which can be constructed to provide foolproof stacking of those gridworks.
Figure 11:
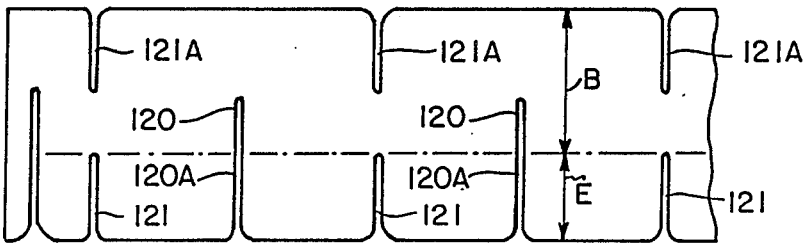
FIG. 11 shows a side view of one end of a strip which can be used to construct the foolproof stacking gridworks of FIG. 10.
Figure 12:
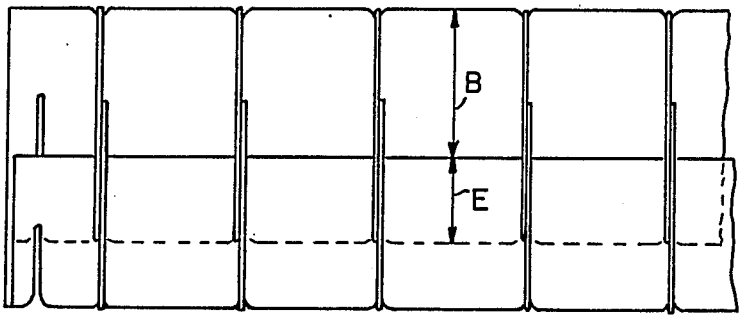
FIG. 12 is a side view of the stacked gridworks of FIG. 10.

Ideally, when gridworks 100 are to be stacked for formation of walls or the like, they are formed such that the edges of the strips 104,108 vertically overlap one another to effectively reinforce and unitize the columns formed by the stacked cells 102 of the gridworks 100. A preferred form of the present invention which facilitates overlapping strips 104,108 to reinforce and unitize the columns formed by the cells 102 of the gridworks 100 is shown in FIGS. 6 and 10–12. The strips are formed, as shown in FIGS. 6 and 11, and can be utilized in varying lengths to define longitudinal strips 104 and latitudinal strips 108 for gridworks 100 constructed generally as shown in FIG. 1. Accordingly, only a corner section of a stacked arrangement of two such gridworks is shown in FIG. 12. Although, only a corner section of two stacked gridworks is shown in FIGS. 10 and 12, it should be apparent that any number of such gridworks can be stacked, with the stacks interlocked to form a desired earthwork structure.

The collapsible gridwork 100 in accordance with this aspect of the present invention, as shown in FIGS. 10–12, comprises a first plurality of longitudinal strips 104 having a second plurality of defined spaced slots 106 alternately formed into the sides thereof. A second plurality of latitudinal strips 108 equal in number to the second plurality of slots 106 similarly has a plurality of defined slots 110 equal in number to the first plurality of strips 104. The longitudinal and latitudinal strips 104,108 are interwoven by engaging slots on one side of the longitudinal strips 104 with corresponding slots on the opposite side of the latitudinal strips 108 to form the gridwork 100. The slots 106,110 are formed of compatible depths such that the longitudinal and latitudinal strips 104,108 engage one another at inner terminations of the slots 106,110 when the gridwork 100 is assembled.

Two forms of gridworks 100 in accordance with this aspect of the present invention can be stacked in a foolproof manner. i.e.. such gridworks will stack with one another regardless of the relative orientation of the gridworks to one another. The two forms of such gridworks can be identified by the position of the leftmost slot of the top strip 104C of a gridwork 100 when viewed in plan (see FIG. 2A). For foolproof stackable gridworks, the first and second pluralities. i.e.. the numbers of the longitudinal and latitudinal strips 104,108, must be of even numbers.

One form of foolproof stackable gridwork is formed by making the leftmost slot of the top strip 104C viewed in plan of all gridworks face downwardly. The second form of foolproof stackable gridwork which also requires the first and second pluralities. i.e., the numbers of the longitudinal and latitudinal strips 104,108, to be even, is formed by constructing all gridworks such that the leftmost slot of the top strip 104C faces upwardly for all such gridworks. Provided that a number of gridworks of the same form are stacked in alignment with one another, such stack will be stable since each intersection of an upper gridwork will define a slotless strip surface which perpendicularly engages a slotless strip surface of an intersection of a lower gridwork. Such gridworks can also be stacked in tiers: provided an even number of cells are skipped between tiers.

To stabilize and align gridworks stacked one upon another and to unitize or compartmentalize the cellular columns formed thereby, it is preferred to extend the longitudinal strips 104 and the latitudinal strips 108 in width such that the extensions project vertically into a vertically adjacent gridwork 100. To accommodate stacking of such gridworks, the extensions are slotted, as shown in FIG. 11, by extending the slots 120 on the side adjacent the extension as indicated at 120A and by adding additional slots 121 aligned with the slots 121A on the opposite side of the strip. Stacking can be further facilitated by making the extensions on the longitudinal strips of a different length than the extensions on the latitudinal strips.

Such a structure is shown in FIGS. 10–12 wherein both the longitudinal and latitudinal strips 104,108 include base strips B defined by the additional slots 121 formed into one side of the strips in alignment with the slots 121A formed into the opposite sides of the strips, the extensions E extend beyond the base strips B such that they overlap portions of the base strips B of a second gridwork 100 which may be a base gridwork, as shown in FIG. 1, or a gridwork having reinforcing walls, as shown in FIG. 9.

By having each of the longitudinal and latitudinal strips 104,108 define extensions E which overlap portions of the base walls B of the gridwork 100 upon which they are stacked, the overlapping strip structures reinforce and compartmentalize or unitize the cellular columns formed by the cells 102 of the gridworks 100. Hence, each cellular column is effectively independent of the others such that if damage occurs to that column and the filling material leaks from it, it will not effect the surrounding columns due to the reinforced overlapping construction. Preferably, the extensions E of the base walls B of the longitudinal and latitudinal strips 104 and 108 extend inside the side walls of cells of a first gridwork 100 upon which a second gridwork 100 is stacked. This provides the strongest structure for the columns defined by the reinforced overlapped cell walls.

Figure 14:
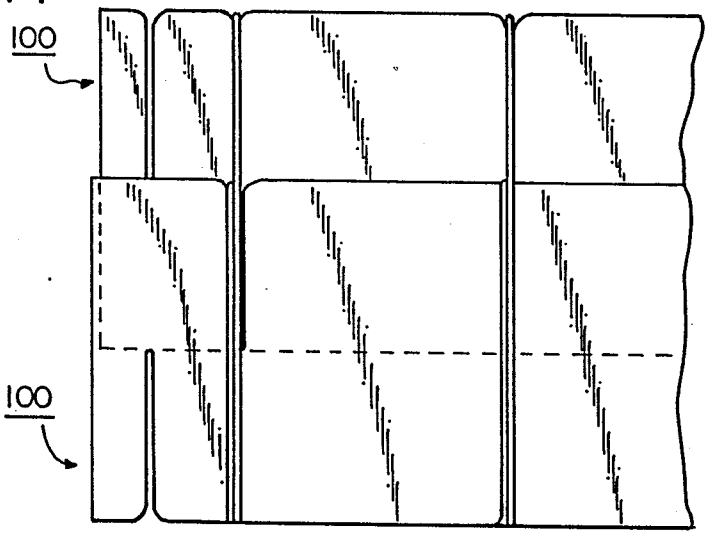
FIG. 14 shows a side view of the gridworks of FIG. 13.
Figure 13:
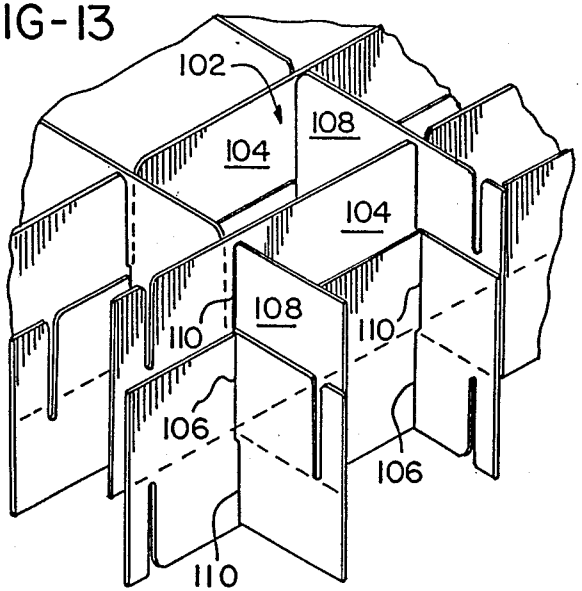
FIG. 13 shows gridworks in accordance with the present invention which can be constructed to provide extremely strong stacked structure.

A second stacking arrangement for gridworks 100 in accordance with the present invention is shown in FIGS. 13 and 14. In this arrangement, the gridworks 100 preferably include somewhat wider slots and are formed such that the intersections of the longitudinal strips 104 and latitudinal strips 108 are not the same for gridworks 100 to be stacked one above the other. In this configuration, for example, a lower longitudinal strip 104 at an intersection will have an upper slot, while the upper longitudinal strip 104 at the same intersection will have a downward slot such that both slots engage the latitudinal walls of the two gridworks 100 and fit snugly into one another. In the illustrated embodiment of this stacked or nested gridwork arrangement, the slots are formed to be approximately equal in depth to one-half of the strip widths of the longitudinal and latitudinal strips 104 and 108 such that the walls of the cells 102 are essentially doubled in thickness when gridworks 100 are stacked one upon the other to define a very strong and stable stacked structure. Other slot depths can be used to reduce the overlap and thereby require less gridworks for a given height structure. Such reduced slot depth is at a cost of a somewhat reduced strength structure.

If one gridwork construction is desired to be used to form such interlocked stackable gridworks, the gridworks must have an odd number of longitudinal strips 104, or latitudinal strips 108, or both longitudinal and latitudinal strips 104 and 108. If an even number of longitudinal and latitudinal strips 104 and 108 are utilized as in accordance with the stack structure shown in FIGS. 10–12, it is noted that a stacking arrangement similar to that shown in FIGS. 13 and 14 is possible; however, two unit constructions would have to be used and identified, for example, as A units and B units defined by the orientation of the leftmost slot in the upper longitudinal strip 104C of the gridwork 100 of the foolproof stacking arrangement, as described above, and the units would have to be alternated for such stacking.

To summarize the stacking arrangements of gridworks 100 in accordance with the present invention, if the intersection of a longitudinal strip 104 and latitudinal strip 108 is exactly the same as the intersection of the longitudinal strip 104 and the latitudinal strip 108 upon which it is to be stacked, the gridworks will be stably supported one upon the other, as shown in FIG. 10, since a slotless portion of either a longitudinal or a latitudinal strip will perpendicularly engage a slotless portion of a latitudinal or longitudinal strip at the intersection. This is the situation in the stacking arrangement shown in FIGS. 10–12, with overlapping being provided by the extensions E of the strips shown in FIG. 11. Alternately, if the orientations of the longitudinal and latitudinal strips 104,108 at intersections vertically adjacent one another are not the same, the gridworks when stacked will tend to merge with one another as shown in the stacking arrangement of FIGS. 13 and 14.

Figure 16:
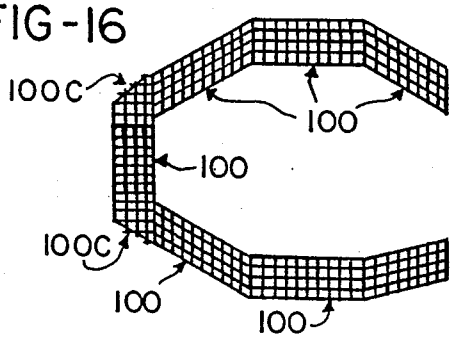
FIG. 16 shows the various cell configurations of a plurality of interlocked gridworks in accordance with the present invention.
Figure 15:
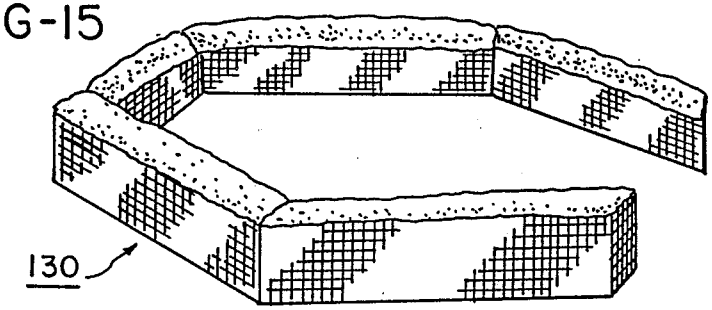
FIG. 15 shows the advantageous construction of a bulwark by means of stacked interlocked gridworks formed in accordance with the present invention.
Figure 18:
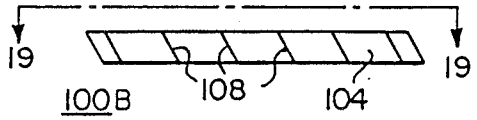
FIGS. 17–19 show gridworks in accordance with the present invention formed with annularly oriented slots for use on inclines.

A bulwark structure 130 constructed in accordance with the present invention is shown in FIG. 15. In this structure, gridworks 100 formed as described above are initially stacked in any one of the possible ways of stacking such gridworks, Preferably one of the overlapping arrangements described. Typically, the gridworks of FIG. 1 would provide the weakest structure, with the stacking arrangement of FIG. 10 providing a greatly increased strength for the structure 130, and the stacking arrangement of FIGS. 13 and 14 providing the ultimate strength in accordance with the present invention. The gridworks would be formed into the desired structure and interlocked to one another in a first base layer which could be the double wall configuration as shown in FIG. 9. A plan view of a single layer of a simple C-shaped base structure for a bulwark is shown in FIG. 16 showing the various parallelogram configurations of the cells.

Next, one or two additional gridworks 100 would be stacked and interlocked around the structure to be formed. The two to three high gridwork structure is then filled, either manually, or by a frontloader, with sand, gravel, earth or any available filler, and then additional gridworks would be formed and interlocked on top of those until the final desired height was reached. If gridworks 100 as shown in FIG. 1 are used, it may be desirable to include geotextile between the layers of the gridwork to reduce loss of the filler. If the stacking arrangements shown in FIGS. 10–14 are utilized, geotextile would not be required due to the compartmentalized or unitized structure of the columns formed by the multiple wall, overlapping cells of the gridwork. It is noted that it may be desirable to fill the outermost cells of the bottom gridwork with sandbags or line them with geotextile to prevent leakage of fill from the base gridworks.

Figure 17:
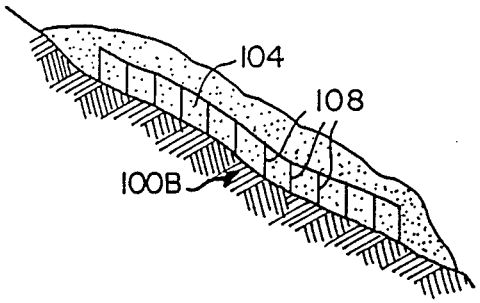
Figure 19:
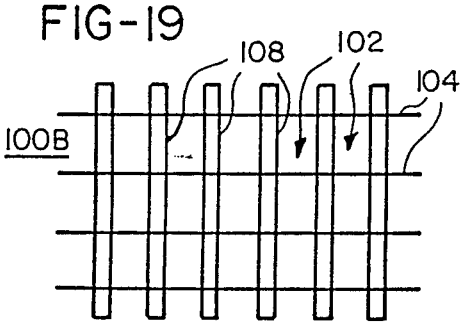

FIGS. 8 and 17–19 show a collapsible gridwork 100B in accordance with the present invention wherein the slots in the latitudinal strips 108 are oriented at substantially 90° to the side of the strips 108 and the slots in the longitudinal strips 104 are oriented at an angle of approximately 60°. When this gridwork is oriented on an incline having an angle which is the 90° complement of the angle of the inclined slots in the longitudinal strips 104, the sidewalls of the cells 102 which are defined by the latitudinal strips 108 are at a substantially vertical orientation to thereby better retain fill which is contained within the gridwork 100, as best shown in FIG. 17.

Figure 20:
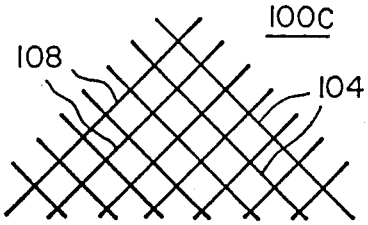
FIG. 20 shows a triangular gridwork in accordance with the present invention.

It should be clear that a portion of the gridwork 100 in accordance with the present invention may be severed to define a gridwork which is not of a rectangular or parallelogram form. For example, a triangular gridwork 100C, as shown in FIG. 20, comprises a corner portion of the gridwork 100. This collapsible gridwork 100C comprises a first plurality of longitudinal strips 104 having defined spaced slots alternately formed into the sides, and a second plurality of latitudinal strips 108 having defined spaced slots alternately formed into the sides thereof. The longitudinal and latitudinal strips 104,108 are interwoven by engaging slots on one side of the longitudinal strips 104 with corresponding slots on the opposite side of the latitudinal strips 108, as previously described, to form the triangular gridwork 100C of FIG. 20. The slots are of compatible depths such that the longitudinal and latitudinal strips 104,108 engage one another at inner terminations of the slots. It is noted that even the triangular gridwork 100C in accordance with the present invention may still be collapsed into a multilayer strip configuration, and also into a flat configuration although the flat configuration is not rectangular as should be apparent. In the collapsible gridwork of FIG. 20, the longitudinal and latitudinal strips 104,108 are of varying lengths such that the 100C defines a triangular corner section which used to cojoin two or three gridworks to one as shown in FIG. 16.

Figure 21:
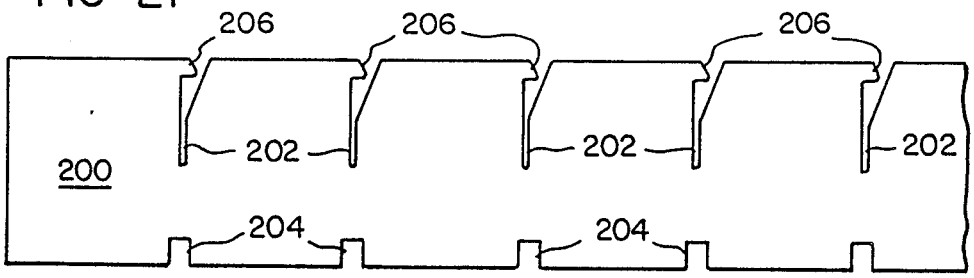
FIG. 21 shows a strip pattern for forming a gridwork in accordance with an alternate embodiment of the present invention.

While the foregoing description has been directed to the preferred forms of the present invention which are formed by interweaving strips having slots on alternate sides thereof, an alternate embodiment of the present invention can be formed by a modified eggcrate configuration. Such a gridwork in accordance with the present invention comprises a plurality of strips 200, as shown in FIG. 21 each having defined spaced slots 202 formed into side thereof and notches 204 formed into the opposite side in alignment with the slots 202.

The strips 200 are divided into first and groups which are perpendicularly oriented to one another, and positioned such that strips 200 of the first group have all slots facing upwardly and strips 200 of the second group have all slots facing downwardly, and the eggcrate gridwork in accordance with the present is formed much like the eggcrate gridwork of prior art by intermeshing the upwardly facing slots with the downwardly facing slots. However, in accordance with the present invention, the strips further define means for interlocking the strips 200 to one another to stabilize the gridwork yet permit the gridwork to be collapsed into a multilayer strip somewhat longer than any of the strips 200 making up the gridwork. In the illustrated embodiment, the interlocking means comprises tabs 206 which engage the notches 204 of intermeshed strips. The various improvements, as previously described with reference to the preferred interwoven embodiments of the present invention, are equally applicable to this alternate gridwork embodiment. For example, strip width extensions to define overlapped cell walls for stacking, the length extensions for interlocking two or more gridworks together, and the stacking arrangements previously described can be applied to this alternate gridwork embodiment.

It will be apparent from the above description that a variety of inexpensive, easily transportable collapsible gridworks have been disclosed for confining fluent materials to reinforce or construct various stable structures made from such fluent materials. Such gridworks can be quickly and easily expanded and interlocked with other units, both vertically and horizontally, to receive locally available fluent materials delivered either manually or mechanically, which gridworks can remain for years or be readily dismantled, transported and reused. The gridworks in accordance with the present invention find many applications in a variety of technologies. Such applications include, but are not limited to, the construction of roadways, railways, runways, parking lots, landing pads, parking aprons, revetments, fortifications, bunkers and emplacements; flood and erosion control; slope stabilization; temporary or permanent plantings; construction of temporary grain storage structures and the like; and concrete reinforcement wherein selected strips would have a reduced rather than an overlapping configuration such that the concrete would flow within the gridwork and be reinforced thereby.

The exact geometry of gridworks when in place for any application may be dictated by the specific nature of the application. For example, in stabilization of a slope or protection of a waterway bank against erosion, it may be desirable to have individual cell walls in the gridwork structure vertical rather than perpendicular to the surface of the slope. This is readily accomplished in accordance with the disclosed angularly oriented slots in the longitudinal or latitudinal strips as described above. In addition, the gridworks may be stacked in tiers; however, the setback of one tier relative to another will be dictated by the particular form of gridwork utilized. For example, if the foolproof stacking gridworks of FIGS. 10–12 are utilized, the tiering offsets must be in even cell increments for stable stacking. Other tier offset requirements should be apparent in view of the present disclosure.

Of course, gridwork cells may also be filled or capped with concrete, asphalt or the like for appropriate applications. The gridworks can also be reinforced by engaging the upper and/or lower strips in slotted reinforcing beams on bars, with the strips being secured thereto, or not, dependent upon the application. In reinforcement of a concrete pad, surface discontinuities of the concrete can be avoided through a reduction in the height of the strips making up the grid except at the places where the grid strips interlock. Additional applications, modifications and variations of gridworks in accordance with the present invention will be apparent to those skilled in the art, and are considered to be within the scope of the present invention.

Accordingly, while the forms of apparatus described constitute preferred embodiments of this invention, it is to be understood that the invention is not limited to these precise forms of apparatus and that changes may be made therein without departing from the scope of the invention which is defined in the appended claims.

What is claimed is:

1. A collapsible gridwork designed to be vertically stacked with at least one additional gridwork for confining fluent materials within cells defined by said gridwork to convert said fluent materials into stable columns capable of withstanding substantial vertical and horizontal loading, said gridwork comprising a plurality of strips each having defined spaced slots formed into one side thereof, said strips being divided into first and second groups which are perpendicularly orienting to one another and positioned such that strips of said first group have all slots facing upwardly and strips of said second groups have all slots facing downwardly, said gridwork being formed by intermeshing said upwardly facing slots with said downwardly facing lots, said strips further defining means for interlocking said strips to stabilize said gridwork yet permitting said gridwork to be collapsed into a multilayer strip somewhat longer than any of said strips and said gridwork further comprising stabilizing means for reinforcing and aligning gridworks stacked one upon another, said stabilizing means comprising width extensions in at least some of said plurality of strips, said width extensions vertically extending beyond at least one side of said gridwork to overlap with strips of at least one vertically adjacent gridwork to thereby reinforce and align gridworks stacked one upon the other, said width extensions being slotted to permit stacking with said slots being narrow to ensure alignment of stacked gridworks, retention of fluent material and improved stability of stacked gridworks subjected to horizontal loading.

2. A collapsible gridwork for confining fluent materials as claimed in claim 1 wherein said width extensions extend beyond one side of strips used to form a base gridwork and extend beyond both sides of strips used to form upper gridworks which are stacked upon said base gridwork and one another to form stable columns for confining fluent material.

3. A collapsible gridwork for confining fluent materials as claimed in claim 1 wherein at least some of said plurality of strips include length extensions beyond outermost perpendicular strips of the gridwork, which length extensions include gridwork coupling means for horizontally interconnecting two or more gridworks to one another, said gridwork coupling means comprising slots formed into said length extensions whereby gridworks can be interlocked to one another via said extension by engaging the slots thereof.

4. A collapsible gridwork for confining fluent materials as claimed in claim 3 wherein said slots are formed into said length extension at a reduced slot spacing relative to the defined spaced slots formed into said plurality of strips whereby gridworks can be interlocked to one another via said extensions by engaging the slots thereof.

5. A collapsible gridwork for confining fluent materials as claimed in claim 4 wherein the defined spaced slots are spaced uniformly and the spacing to the slots in said length extensions is one-half the spacing between the remaining slots in said plurality of strips.

6. A collapsible gridwork for confining fluent materials as claimed in claim 5 further comprising at least one additional strip intermeshing with said length extensions to form at least one reinforcing wall for said gridwork.

7. A vertically extending structure made up of at least two collapsible gridworks stacked one upon another for confining fluent materials within cells defined by the stacked gridwork structure to convert said fluent materials into stable columns capable of withstanding substantial vertical and horizontal loading wherein each of said gridworks comprises a plurality of strips which each have defined spaced slots formed into one side thereof, said strips being divided into first and second groups which are perpendicularly orienting to one another and positioned such that strips of said first group have all slots facing upwardly and strips of said second group have all slots facing downwardly, each of said gridworks being formed by intermeshing said upwardly facing slots with said downwardly facing slots, said strips further defining means for interlocking said strips to stabilize each of said gridworks yet permit said gridworks to be collapsed into multilayer strips somewhat longer than any one of said plurality of strips and each of said gridworks further comprising stabilizing means for reinforcing and aligning the two or more gridworks which are stacked one upon another to form said vertically extending structure.

8. A vertically extending structure for confining fluent materials as claimed in claim 7 wherein said stabilizing means comprises the outermost strips of said first group being extended in width to extend vertically beyond said gridwork to reinforce and align the stacked gridworks, said portions of said outermost strips of said first groups extending vertically beyond said gridworks being slotted to permit stacking.

9. A vertically extending structure for confining fluent materials as claimed in claim 8 wherein said stabilizing means further comprises the outermost strips of said second group being extended in width to extend vertically beyond said gridwork to reinforce and align stacked gridworks, said portions of said outermost strips of said second groups extending vertically beyond said gridworks being slotted to permit stacking.

10. A vertically extending structure for confining fluent materials as claimed in claim 9 wherein at least some of said strips include length extensions beyond the outermost perpendicular strips, which length extensions include gridwork coupling means for horizontally interconnecting two or more gridworks to one another, said gridwork coupling means comprising slots formed into said length extensions such that the vertically extending structures formed by stacking at least two of said gridworks can be interlocked to one another via said extensions by engaging the slots thereof.

11. A vertically extending structure for confining fluent materials as claimed in claim 10 wherein said slots are formed into said length extensions at a reduced slot spacing relative to the defined spaced slots formed into said plurality of strips.

12. A vertically extending structure for confining fluent materials as claimed in claim 11 wherein the strip slots are uniformly spaced and the spacing to the slots in said length extensions is one-half the spacing between the remaining slots in the strips.

13. A vertically extending structure for confining fluent materials as claimed in claim 12 wherein at least one of said gridworks further comprises at least one additional strip intermeshing with said length extensions to form at least one reinforcing wall for said at least one gridwork.

14. A vertically extending structure for confining fluent materials as claimed in claim 7 wherein at least one of said strips of said first groups is extended in width to extend vertically beyond said gridworks to reinforce the stacked gridworks, said at least one of said strips of said first groups extending vertically beyond said gridworks being slotted to permit stacking.

15. A vertically extending structure for confining fluent materials as claimed in claim 14 wherein at least one of said strips of said second groups is extended in width to extend vertically beyond said gridwork to reinforce stacked gridworks, said at least one of said strips of said second groups extending vertically beyond said gridworks being slotted to permit stacking.

16. A vertically extending structure for confining fluent materials as claimed in claim 15 wherein at least some of said strips include length extensions beyond outermost perpendicular strips, which length extensions include gridwork coupling means formed thereinto for interconnecting two or more gridworks to one another, said gridwork coupling means comprising slots formed into said length extensions whereby gridworks and thereby the vertically stacked structure formed by stacking two or more gridworks can be horizontally interlocked to one another via said extensions by engaging the slots thereof.

17. A vertically extending structure for confining fluent materials as claimed in claim 16 wherein said slots are formed into said length extensions at a reduced slot spacing relative to the defined spaced slots formed into said plurality of strips.

18. A vertically extending structure for confining fluent materials as claimed in claim 16 wherein at least one of said gridworks further comprises at least one additional strip intermeshing with said length extensions to form at least one reinforcing wall for said at least one gridwork.

19. A vertically extending structure for confining fluent materials as claimed in claim 17 wherein the slots are uniformly spaced and the spacing to the slots in said length extensions is one-half the spacing between the remaining slots in the strips.

20. A vertically extending structure for confining fluent materials as claimed in claim 19 wherein at least of said gridworks further comprises at least one additional strip intermeshing with said length extensions to form at least one reinforcing wall for said at least one gridwork.

21. A vertically extending structure for confining fluent materials as claimed in claim 17 wherein said slots are uniformly spaced.

* * * * *